US006712210B1

(12) United States Patent
Sabath et al.

(10) Patent No.: US 6,712,210 B1
(45) Date of Patent: Mar. 30, 2004

(54) NOVELTY DATE PACKAGE

(76) Inventors: Anna Sabath, 2465 Bridle Path Dr., Gilroy, CA (US) 94020; Charles H. Reynolds, 2465 Bridle Path Dr., Gilroy, CA (US) 94020

( * ) Notice: Subject to any disclaimer, the term of this patent is extended or adjusted under 35 U.S.C. 154(b) by 0 days.

(21) Appl. No.: 10/057,764

(22) Filed: Jan. 24, 2002

(51) Int. Cl.[7] ..... B65D 85/34

(52) U.S. Cl. ..... 206/457; D9/313; 206/459.5; 206/521.6; 426/104; 446/73

(58) Field of Search ..... D7/506; D9/313, D9/329; 206/457, 459.5, 521.6, 562, 563; 426/104; 446/73, 75

(56) References Cited

U.S. PATENT DOCUMENTS 1,589,911 A * 6/1926 Waters ..... 206/457
2,161,910 A * 6/1939 Callahan ..... 426/104
4,573,586 A * 3/1986 Helmer ..... 206/563
4,759,935 A * 7/1988 Toshitsugu ..... 426/110
5,064,398 A * 11/1991 Richardson ..... 446/75
5,229,149 A * 7/1993 Cone ..... 426/104
5,413,801 A * 5/1995 McIlwain ..... 426/104

* cited by examiner

*Primary Examiner*—Jim Foster
(74) *Attorney, Agent, or Firm*—Quine Intellectual Property Law Group, P.C.

(57) ABSTRACT

Novelty Date Package with a series of stepped platforms forming a base for a package, each the platform having a plurality of recesses capable of removably retaining the lower portion of a date, a date retaining member for preventing the side to side motion of the dates on each platform, a laminated plastic and paper sleeve that surrounds the front and side portions of each date, each the sleeve having a printed image of a person, each the sleeve partially covering the front each date so that the sides and top of each date are visible, a removable and replaceable clear cover that slips over said stepped platform base that helps protect and retain said dates, and a graphic card member that covers a portion of the top, bottom and sides of said date package.

1 Claim, 2 Drawing Sheets

NOVELTY DATE PACKAGE

BACKGROUND OF THE INVENTION

This invention relates generally to the field of food packaging, and more particularly to a novelty date package.

Dried dates have been a popular and nutritional form of fruit for thousands of years. Dates are traditionally packaged in plastic boxes or poly bags or sold loosely and packaged by the purchaser and placed in a bag or box. Although these means of packaging dates are quite adequate, they do not impart any other meaning or quality other than the convenient transport of the dates. They also do not separate the dates thereby increasing the chance of bruising the dates during transport.

SUMMARY OF THE INVENTION

The primary object of the invention is to provide a novelty package for dried dates that individually positions and retains the dates on a series of stepped platforms.

Another object of the invention is to provide a novelty package for dried dates where each date is individually wrapped in a sleeve, each sleeve having a graphic image of a person.

Another object of the invention is to take advantage of the play on words between a date as defined by a fruit product and a date as defined as two people going out together.

Other objects and advantages of the present invention will become apparent from the following descriptions, taken in connection with the accompanying drawings, wherein, by way of illustration and example, an embodiment of the present invention is disclosed.

Novelty Date Package comprising: a series of stepped platforms forming a base for a package, each said platform having a plurality of recesses capable of removably retaining the lower portion of a date, a date retaining member for preventing the side to side motion of the dates on each platform, a laminated plastic and paper sleeve that surrounds the front and side portions of each date, each said sleeve having a printed image of a person, each said sleeve partially covering the front each date so that the sides and top of each date are visible, a removable and replaceable clear cover that slips over said stepped platform base that helps protect and retain said dates, and a graphic card member that covers a portion of the top, bottom and sides of said date package.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
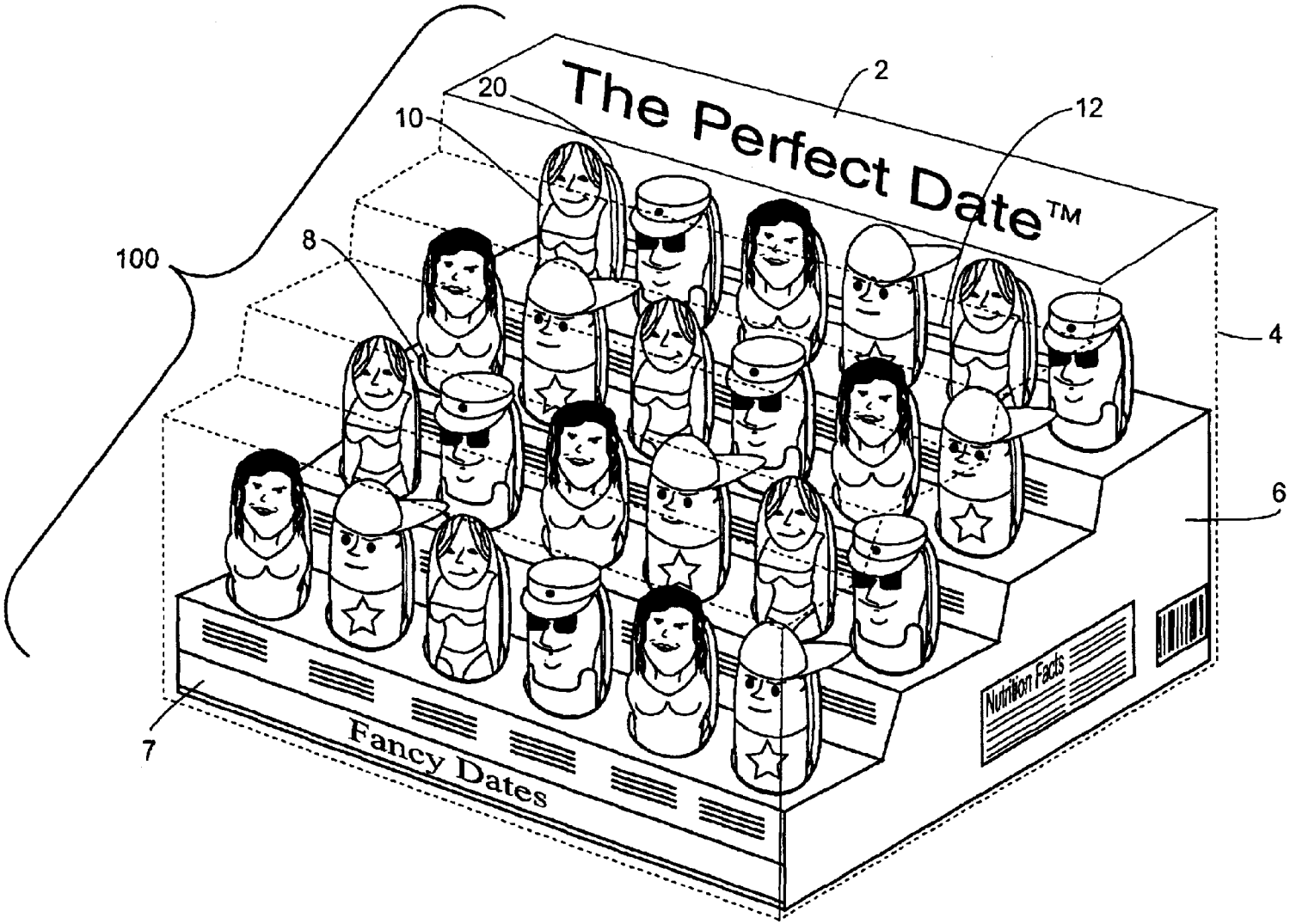
FIG. 1 is a perspective view of the date package of the present invention.
Figure 2:
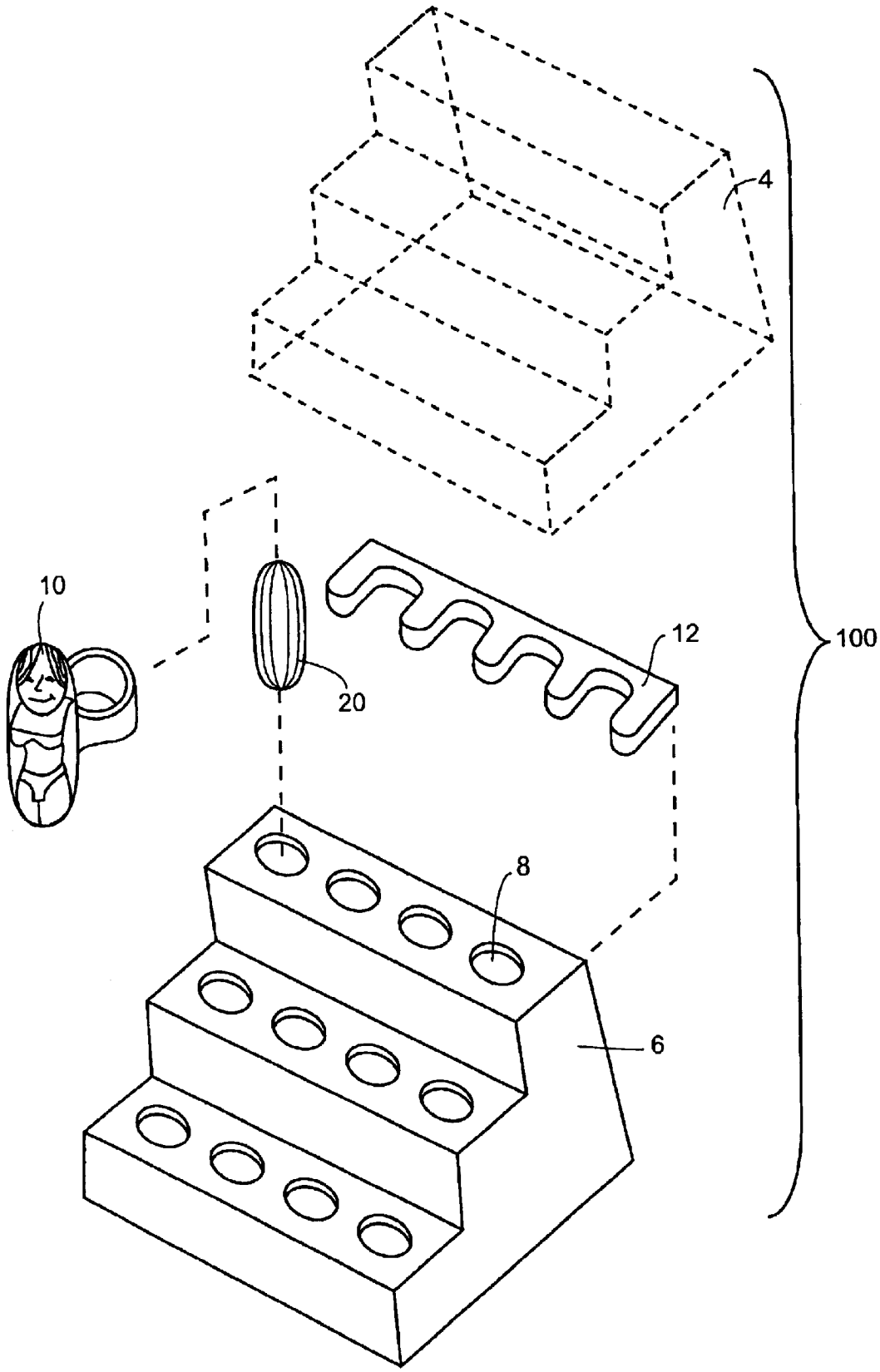
FIG. 2 is an exploded view of the date package of the present invention.

Referring now to FIG. 1 we see a perspective view of the date package 100 of the present invention. Stepped base 6 can be made of thin plastic by vacuum forming or can be die cut from paperboard material or the like. A plurality of circular depressions 8 help retain dates 20, each of which is wrapped in a die cut laminated paper graphic depicting a person 10. Characters such as "surfer Dan" 10 give the date a human persona. In this way the date takes on two properties, one as a food and another as a person to go out with. This novelty package 100 is meant to be humorous and to be given as a gift to someone who may have a hard time getting a real date, meaning someone to go out with. Another application of the present invention involves taking photo's of real people and reducing them to fit around a date in the same way that pre printed characters 10 and others are used. For example, a high school football team may take photos of the teams football players and the teams cheer leaders. These photos can then be reduced and formatted with attachment tabs so that they can be wrapped around edible dates. The team can then sell the dates to raise money for the team. Clear plastic cover 4 protects and helps retain the dates 10. Retaining member 12 prevents the dates from falling sideways. Graphic panel 2 adds to the packaging by providing space for printing descriptive language. Graphic panel 2 starts at the top of the package and then proceeds down the rear of the package and then proceeds under the base 6 and terminates at the lower front 7. The graphic panel 2 is held in place by clear cover 2. FIG. 2 shows a clear view of the components of the present invention 100. Base 6 is stepped and includes a plurality of circular recesses 8. Dates 20 fit into the recesses 8. Graphic wrap 10 fits over each date 20. Retaining member 12 is situated behind each level of dates and keep the dates from falling over. Clear cover 4 slips over base 6 and helps retain dates 20. Graphic panel 2 is not shown in this view for purposes of clarity.

The above description and illustrations show that the present invention is a novel way to package and display dates so that the dates appear as little people that can be considered as potential dates for the owner of the date package. Additionally, the package design of the present invention helps to protect the dates from bruising during transport.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Novelty Date Package comprising:

a series of stepped platforms forming a base for a package;

each said platform having a plurality of recesses capable of removably retaining the lower portion of a date;

a date retaining member for preventing the side to side motion of the dates on each platform;

a laminated plastic and paper sleeve that surrounds the front and side portions of each date;

each said sleeve having a printed image of a person;

each said sleeve partially covering the front each date so that the sides and top of each date are visible;

and a removable and replaceable clear cover that slips over said stepped platform base that helps protect and retain said dates.

* * * * *